US006559444B2

(12) United States Patent
Franzen

(10) Patent No.: US 6,559,444 B2
(45) Date of Patent: May 6, 2003

(54) TANDEM MASS SPECTROMETER COMPRISING ONLY TWO QUADRUPOLE FILTERS

(75) Inventor: Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 0 days.

(21) Appl. No.: 09/801,204

(22) Filed: Mar. 7, 2001

(65) Prior Publication Data

US 2001/0020679 A1 Sep. 13, 2001

(30) Foreign Application Priority Data

Mar. 7, 2000 (DE) ..... 100 10 902

(51) Int. Cl.[7] ..... H01J 49/26
(52) U.S. Cl. ..... 250/293; 250/287; 250/423 R
(58) Field of Search ..... 250/293, 281, 250/283, 287, 282, 396 R, 292, 290, 423 R

(56) References Cited

U.S. PATENT DOCUMENTS

| | | | | |
|---|---|---|---|---|
| 4,234,791 A | | 11/1980 | Enke et al. | |
| 4,329,582 A | | 5/1982 | French et al. | |
| 4,963,736 A | | 10/1990 | Douglas et al. | |
| 5,179,278 A | | 1/1993 | Douglas | |
| 5,572,035 A | * | 11/1996 | Franzen | 250/396 R |
| 6,011,259 A | | 1/2000 | Whitehouse et al. | |
| 6,107,623 A | * | 8/2000 | Bateman et al. | 250/282 |
| 6,107,628 A | * | 8/2000 | Smith et al. | 250/292 |
| 6,285,027 B1 | * | 9/2001 | Chernushevich et al. | 250/287 |

FOREIGN PATENT DOCUMENTS

| | | |
|---|---|---|
| GB | 2 032 985 | 5/1997 |
| WO | WO 97/07530 | 2/1997 |
| WO | WO 97/43036 | 9/1997 |
| WO | WO 97/49111 | 12/1997 |
| WO | WO 99/38185 | 7/1999 |

* cited by examiner

*Primary Examiner*—John R. Lee
*Assistant Examiner*—Zia R. Hashmi

(57) ABSTRACT

The invention relates to a tandem mass spectrometer and a method for scanning daughter ion spectra which uses a quadrupole mass spectrometer for selection of parent ions and another one for the measurement of the daughter ions.

The invention consists of not using a conventional third quadrupole filter as a collision cell for fragmentation of the parent ions but an ion guide system with helically coiled wires, especially in the form of a double helix, in which the ions can be completely decelerated and can be actively fed to the outlet aperture.

14 Claims, 1 Drawing Sheet

TANDEM MASS SPECTROMETER COMPRISING ONLY TWO QUADRUPOLE FILTERS

The invention relates to a tandem mass spectrometer and a method for scanning daughter ion spectra which uses a quadrupole mass spectrometer for selection of parent ions and another one for the measurement of the daughter ions.

The invention consists of not using a conventional third quadrupole filter as a collision cell for fragmentation of the parent ions but an ion guide system with helically coiled wires, especially in the form of a double helix, in which the ions can be completely decelerated and can be actively fed to the outlet aperture.

PRIOR ART

Quadrupole mass spectrometers can be traced back to Wolfgang Paul. In patent DE 944 900 (U.S. Pat. No. 2,939,952) by Paul and Steinwedel from the priority year 1953 both the quadrupole mass filter and the quadrupole ion trap are described. Knowledge of quadrupole mass spectrometry is assumed here.

Tandem mass spectrometry is the measurement of daughter ions in a second mass spectrometer, whereby the daughter ions are obtained from parent ions which are selected in a first mass spectrometer. Usually the daughter or fragment ions are generated in collisionally induced processes with gas molecules between the first and second mass spectrometer, but other types of fragmentation are also known for the parent ions.

Tandem mass spectrometry with quadrupole filters has been known for about 20 years (U.S. Pat. No. 4,234,791, C. G. Enke, R. A. Yost and J. D. Morrison; U.S. Pat. No. 4,329,582, J. B. French and P. H. Dawson) and normally uses a technique which is based on "triple quadrupoles" or "triple quads". The first quadrupole serves as a mass spectrometer for selection of the parent ions, the second quadrupole serves as a fragmentation chamber with injection of the selected parent ions into a collision gas, and the third quadrupole serves as a mass analyzer for the resulting daughter or fragment ions.

The first quadrupole mass spectrometer is operated at an RF voltage with superimposed DC voltage, so that a small mass range can be selected (or more precisely: a range for the mass-to-charge ratios which can solely be determined by mass spectrometry). The second quadrupole, on the other hand, is operated only at an RF voltage without any superimposed DC voltage so it only acts as a guidance system for the ions. The ions injected at approx. 20 to 30 electron Volts diffuse very strongly in the collision gas so the guidance system for the ions (also referred to as ion guide system) prevents ion losses. The third quadrupole is again operated with superimposed DC voltage, it filters out ions of a single mass (or rather of a single mass-to-charge ratio). By changing voltages the filtered mass can be altered and in this way an entire spectrum can be scanned across all the masses.

A triple quadrupole mass spectrometer has proved particularly successful for quantitative analysis of mixtures of substances, whereby the mixtures are separated by gas chromatography or liquid chromatography and are fed to the ion source of such a spectrometer. Since the substances are known in principle, it is not necessary to measure the daughter ion spectra entirely. One can leave the mass spectrometer set so that the first quadrupole mass spectrometer admits a characteristic ion of a substance, in the second quadrupole this then produces daughter ions, of which, however, in the third quadrupole again only a characteristic daughter ion is measured. For the measurement of this substance there is therefore no scan by the third quadrupole from mass to mass but both filters remain open constantly. This produces a high transmission for the ions and a high selectivity for the substance sought.

To improve the measuring accuracy from a quantitative aspect one can add a reference substance, preferably an isotope-marked derivative of the test substance; one then measures both substances at the same retention time. By simply switching over the two admission windows of the quadrupole filters for the two substances one can determine their ratio. Here too it is not the entire mass range which is scanned, there is only a switch to and fro between the two admission states.

There are also other highly interesting methods of operation for triple quadrupole mass spectrometers but these will not be discussed individually here.

The triple quadrupole mass spectrometers known nowadays still have, despite many years of development, considerable disadvantages which are to be found in the principle of the equipment. For triple quadrupole mass spectrometers there is a fundamental problem: if one increases the collision yield of daughter ions by increasing the collision gas density in the center quadrupole, one increases the velocity inhomogeneity of the daughter ions at the output from that quadrupole, which leads to inferior transmission when passing to the third quadrupole and to an inferior mass resolution in that quadrupole mass spectrometer. The rods of this analytical quadrupole mass spectrometer must therefore be very long in order to achieve better mass filtering with a long dwell time also for faster ions in that quadrupole field; the inferior transmission on passing to that quadrupole can, however, not be improved. Long quadrupole systems are also difficult and expensive to manufacture.

To solve this fundamental problem a method has become known (Sciex Inc., Thornhill, Canada), which keeps the collision gas density relatively low in the second quadrupole and simultaneously increases the fragmentation through excitation of the ion oscillations in that quadrupole with a resonance dipole alternating field for the parent ions perpendicular to the direction of ion flight. This can be performed with an additional alternating voltage across two opposite poles of the quadrupole. Due to this additional excitation the yield of daughter ions is improved but the fundamental problem of the triple quadrupole mass spectrometer is not completely solved.

The six-dimensional space of spatial and pulse coordinates of particles is referred to as the "phase space". In an ion beam the spatial and pulse coordinates of all the ions fill out a certain part of the phase space and this part is referred to as the "phase space volume". The fundamental problem of any triple quadrupole mass spectrometer is that in the collision quadrupole the phase space volume of the ions is increased and the analytical quadrupole mass spectrometer can only efficiently separate ions of a small phase space volume. The mass resolution of a third quadrupole mass spectrometer therefore is quite essentially dependent on the spatial and velocity distribution of the injected ions.

According to the laws of physics a reduction in phase space volume cannot be achieved by ion-optical means but only by cooling the ion plasma of the ion beam, for example by cooling in a damping gas. Such cooling of the ions by a damping gas (at the expense of time) is, for instance, known from RF quadrupole ion traps. Cooling of the ions of the center quadrupole field fails, however, due to the fact that the ions require a residual forward velocity in order to reliably fly out of the field again.

OBJECTIVE OF THE INVENTION

It is the objective of this invention to find a device in which injected ions are not only fragmented but also cooled so that their phase space volume is reduced. It should then be possible to inject the ions as a fine beam with homogenous energy into a quadrupole mass spectrometer acting as an analyzer.

SUMMARY OF THE INVENTION

The invention consists of using—for fragmentation of the parent ions—an ion guide system with at least one helically coiled wire pair in which the motions of all the ions can be completely damped after their fragmentation due to a high gas density so that they practically come to rest in the gas and collect along the axis of the ion guide system. In such an ion guide system the ions must then be actively guided to the end of the ion guide system by an extra thrust, extracted there and be injected into the analyzing quadrupole mass spectrometer.

An ion guide system which is only comprised of one coiled pair of wires in the form of a double helix is particularly suitable.

Such an ion guide system in the form of a double helix is described in detail in U.S. Pat. No. 5,572,035. It is comprised of two wires coiled helically around the same axis which are connected to the two phases of an RF voltage supply. This double helix can take the form of a cylinder, but also that of a truncated cone or a trumpet, whereby the wall is created by the coils of wire. In that structure a pseudo potential is generated which drives the ions back to the wall when they approach. Along the axis there is a trough of this pseudo potential. The pseudo potential acts on positive and negative ions in the same way. The pseudo potential arises as a time integral over the attracting and repelling forces of the inhomogeneous electrical alternating field of forces on an oscillating particle in the vicinity of the wires. The pseudo potential of a double helix array can be made extremely high, much higher than is possible for ion guide systems made from pole rods.

A reduction in phase space volume particularly depends on matching the length of the ion guide system and the pressure of the damping gas to one another in such a way that the injected ions—apart from thermal diffusion motions—come to rest completely in the gas and thereby collect in the trough of the pseudo potential, that is, along the axis of the ion guide system. Since the ions come to rest in the gas it is necessary, by contrast with the previous use of ion guide systems, to actively drive the ions to the end of the ion guide system.

The ions must be injected into the ion guide system with a kinetic energy which is sufficient for collisionally induced fragmentation. The relatively slow guidance (in a few milliseconds) of the ions, which are then practically at rest, to the end of the ion guide system also helps to cool the daughter ions and cause short-lived, highly excited daughter ions to decompose. As a result a largely background noise-free daughter ion spectrum is obtained in the analytical quadrupole mass spectrometer which is not contaminated by scattered ions from ion decompositions during flight in the quadrupole mass spectrometer.

Filling with gas can be accomplished by operating the ion guide system in a separate vacuum chamber, which is at a required pressure of between 0.01 and 100 Pascal (preferably between 0.1 and 10 Pascal), or by at least partially providing the ion guide system with an envelope so that only the envelope is filled with gas. The gas can then flow through the envelope and thus longitudinally through the double helix.

The active forward thrust of the damped ions can take place in several different ways: (1) The ions can be most simply driven forward by the admitted gas itself if the gas is admitted at the beginning of an envelope round the ion guide system and flows through the ion guide system to the end. (2) If the ion guide system is made conical the ions can be provided with a gentle forward thrust if the cone opens toward the ion outlet, which is not preferred here though. (3) The ion guide system can be provided with a weak axial DC field which guides the ions to the end of the guide system. For example, if the helical wires are each supplied with a DC voltage across both ends a voltage drop will be created along the axis of the ion guide system. It is expedient to make the wires of the double helix from resistance wire. A very weak field of only approx. 0.01 to 1 volt per centimeter (preferably about 0.1 V/cm) is sufficient to drive the ions forward.

Several forward thrust systems can also act simultaneously. If the ion guide system is, for instance, open in a conical shape toward the ion injection (quite definitely a very favorable case), a pseudo potential is created which weakly drives the ions back to the entrance. However, this effect can be overcompensated by an axial DC voltage field.

The ions which are located at the end of the double helix in a fine current thread can now be injected directly into the analytical quadrupole mass spectrometer by keeping the axial potential of the downstream quadrupole mass spectrometer several volts below the axial potential of the double helix. However, this configuration is not particularly advantageous because it is expedient to operate the analytical quadrupole mass spectrometer in its own chamber with a much better vacuum.

A drawing lens is an ion-optical lens which also imparts upon the ions an acceleration at the same time as focusing (or defocusing). Both sides of the lens are therefore at different potentials. This is different from a so-called Einzel lens, which only exercises a focusing (or defocusing) effect, but no acceleration; the Einzel lens thus always has the same potential on both sides. Drawing lenses and Einzel lenses are generally comprised of concentric apertured diaphragms at a fixed distance from one another. A drawing lens system is a system comprised of at least one ion-optical lens in which there is at least one drawing lens.

A drawing lens system can extract the ions from the ion guide system very efficiently if the potential of the second apertured diaphragm extends through the hole of the first apertured diaphragm into the ion guide system. The first apertured diaphragm is approximately at the axial potential of the ion guide. The hole in the second apertured diaphragm should favorably have a smaller diameter than the hole of the first apertured diaphragm. It is also favorable to design the last three diaphragms of a drawing lens system as an Einzel lens, which handles the required focusing.

Since in the ion guide system a gas pressure prevails which is intentionally damping the ion motions but a better vacuum has to prevail in the analytical quadrupole mass spectrometer, it is useful for the two to be in separate vacuum chambers. Then it is expedient to integrate the apertured diaphragm of the drawing lens system with the smallest hole into the wall between the vacuum chambers with a gastight seal. The hole diameter can be approx. 0.5 millimeters. To maintain a good pressure differential it is helpful if the hole forms a small channel. Two apertured diaphragms of the drawing lens system can also be used to generate a differential pump stage by evacuating separately between those two apertured diaphragms.

In addition it is helpful for maintaining a good pressure in the analytical quadrupole mass spectrometer if in the ion guide system the pressure of the damping gas decreases toward the end. This can be achieved if the gas flows in at the beginning and if a pressure drop is created with openings in the envelope along the ion guide system.

Upstream of the ion guide system for ion fragmentation there is an ion selecting quadrupole mass spectrometer which, in turn, can be positioned in a separate vacuum chamber. Parent ions for generating daughter ions can be selected in various ways. Consequently one can select all isotopic ions of a substance with the same charge or only a single isotopic type ("monoisotopic" ions). It is also possible to connect a drawing lens system, which can be used to accelerate the ions on the one hand and to separate the vacuum chambers on the other, between the selective quadrupole mass spectrometer and the ion guide system.

Figure 1:
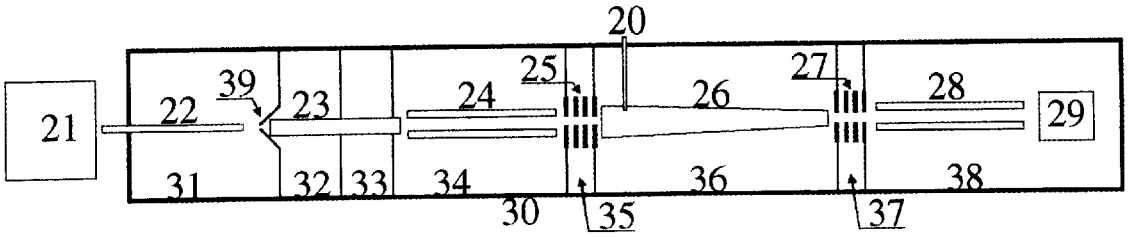
FIG. 1 shows the schematic diagram of a favorable tandem quadrupole mass spectrometer based on this invention. The vacuum system (30) is divided up internally into the chambers (31) to (38), which make up a complex differential pumping system, which maintains the required gas densities and vacuums in the various chambers. The pumps have been omitted for simplification.

The ions are generated in an electrospray ion source (21) outside of the vacuum system (30) and introduced to the first vacuum chamber (31) through a capillary (22). The ions then pass through a gas skimmer (39) into the second vacuum chamber (32), where they are picked up by an RF ion guide system (23). This ion guide system (23) is a conventional, open multipole rod system which extends through vacuum chambers (32) and (33) into chamber (34), in which the ion selecting quadrupole mass spectrometer (24) is located in a good vacuum. The ions emerging from the multipole ion guide system (23) are injected into the ion selecting quadrupole mass spectrometer (24) with a slight potential difference of several volts, where they are filtered out so that only the required parent ions can pass through the quadrupole mass spectrometer (24). At the end of this quadrupole mass spectrometer (24) the parent ions are extracted by a drawing lens system (25), accelerated, and injected into the conical double helix system (26) with an energy of approx. 10 to 30 electron Volts per ion charge. The drawing lens system (25) in turn forms a differential pump chamber (35), which separates the required good vacuum in chamber (34) from the collision gas filled chamber (36). The conical double helix system (26) in this chamber (36) is supplied with collision gas through feeder (20). Here the parent ions are fragmented into daughter ions, the generated ions are cooled and transported to the end of the double helix system, where they are extracted by a further drawing lens system (27), formed into a fine ion beam and injected into the analyzing quadrupole mass spectrometer (28) with approx. 3 to 6 V acceleration. The drawing lens system (27) in turn forms a differential pump chamber (37), which separates the collision gas filled chamber (36) from the good vacuum in the spectrometer chamber (38). That vacuum chamber (38) contains the quadrupole mass spectrometer (28). The ions passing through this mass spectrometer (28) are detected in ion detector (29).

Figure 2:
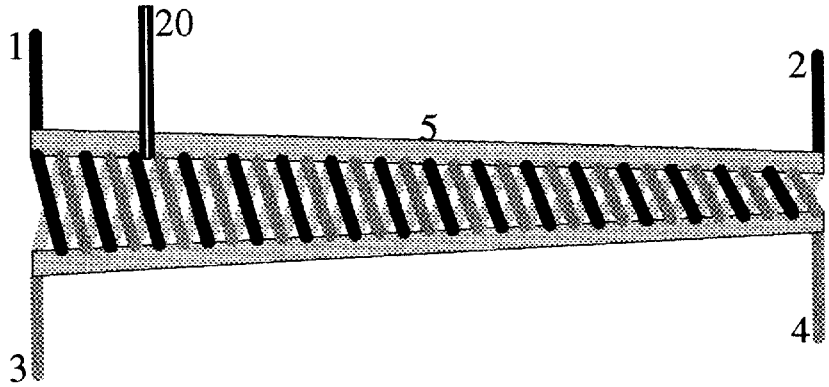

FIG. 2 shows the principle of a conical double helix as an ion guide system. The double helix corresponds to the ion guide system (26) from FIG. 1. A coil extends from wire end (1) to wire end (2) while the second coil extends from wire end (3) to wire end (4). The axial distance between the wires remains the same; therefore a reel core with a two-turn thread used for manufacture can easily be unscrewed. The double helix is surrounded by a stuck-on envelope (5) and has a gas feeder (20). Between wire ends (1) and (2) and wire ends (3) and (4) a DC voltage each can be applied in order to generate an axial DC field. The two phases of the RF voltage are applied to wire ends (1) and (3). The ion injection takes place at the wider end between wire ends (1) and (3), while the ion outlet end is between wire ends (2) and (4).

Figure 3:
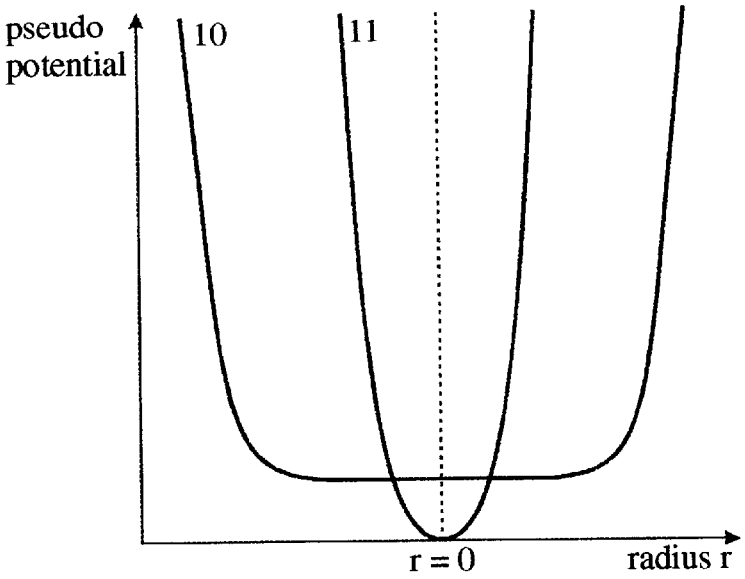

FIG. 3 shows a diagram of the pseudo potential across two cross sections of the double helix. Curve 10 shows the pseudo potential in the injection area, here there is a wide potential well. Curve 11 shows the pseudo potential in the outlet area, here the potential trough is very narrow. If an axial DC field prevails, the minimum in the outlet area is deeper than in the inlet area, as shown in the diagram.

PARTICULARLY FAVORABLE EMBODIMENTS

A tandem quadrupole mass spectrometer is chiefly used when chromatographically separated substances have to be quantified quickly and reliably. Due to the staggered selection of one parent ion type and one daughter ion type a selectivity and specificity are achieved which make it possible to compress the chromatography into a very short space of time and thus shorten analysis time. In this way a high analysis throughput can be achieved with a high level of reliability. The method is applied in preclinical and clinical pharmacokinetics, where tens of thousands of specimens with metabolites have to be quantitatively analyzed throughout their period of decomposition.

Separation of the metabolic substances nowadays usually takes place by means of liquid chromatography (HPLC= high performance liquid chomatography). Ionization is preferably conducted by electrospraying the dissolved substances at atmospheric pressure outside of the vacuum system (ESI=electrospray ionization). The ions are introduced to the vacuum through input apertures or input capillaries and the entering ambient gas (usually nitrogen) is drawn off in several differential pump stages (31) to (34).

The ions which have been generated by an electrospray ion source (21) are, according to a favorable embodiment, injected into an ion guide system (23), which takes the form of a quadrupole, hexapole, or octopole made from straight pole rods, somewhere on their journey to the time-of-flight mass spectrometer (refer to U.S. Pat. No. 4,963,736, D. J. Douglas and J. B. French or U.S. Pat. No. 5,179,278, Donald J. Douglas). This can already take place early in the differential pressure stage (32), whereby then the ion guide system can be taken through the walls between differential pressure stages (32), (33), and (34) (WO 97/43036 A1, C. M. Whitehouse, E. Gulcicek).

An RF ion guide system (23) has the property of keeping ions of moderate energy and not too small a mass away from an imaginary cylindrical wall of the ion guide system. The ions are thus injected as if they were in a pipe. This is performed through a so-called pseudo potential field, a temporally averaged field of forces which acts on the ions (the pseudo potential is mass-dependent, which is of only incidental interest here). The pseudo potential of all the ion guide systems which have become known so far has a trough in the axis of the ion guide system, it rises toward the imaginary cylindrical wall and reflects approaching ions with not to large a kinetic energy at the imaginary cylindrical wall The ion guide systems used so far are so-called multipole rod systems subjected to RF voltages, whereby with four rods a quadrupole system can be created, with six rods a hexapole system, and with eight rods an octopole system. For an ion guide system at least four rods are required and a dipole system comprised of only two rods cannot guide the ions.

From this ion guide system (23) the ions are injected into a first quadrupole mass spectrometer (24). Due to superimposition of an RF voltage and a DC voltage across the four pole rods (which are of hyperbolic design in particularly good systems) this quadrupole mass spectrometer (24) can admit ions of a small mass range. The remaining ions are to be found on unstable trajectories where they are deflected to the pole rods. There they discharge and are thus filtered out of the process. The small mass range (or rather mass-to-charge range) can cover several atomic mass units per charge, but it can also be restricted to a single mass per charge. In this quadrupole mass spectrometer (24) the parent ions chosen for fragmentation are selected.

In a preferred embodiment the selected parent ions are injected into an ion guide system (26), which, however, is not comprised of pole rods but, in accordance with U.S. Pat. No. 5,572,035, consists of coiled wires which are physically helical, as shown in FIG. 2. In principle two, four or more wire coils can be used. For present purposes, however, an ion guide system (26) in the form of a double helix is particularly suitable. The properties of this double helix system can be favorably changed by altering the pitch of the coils, i.e. the distance between the adjacent wires. A particularly favorable embodiment is a conical system (see FIG. 2) or a trumpet-shaped system, which has a wide injection area of relatively large diameter and tapers toward the end. Here the ions from the quadrupole mass spectrometer (24) can be broadly collected, but in the ion guide system (26) they are tapered into an ion thread and fed to the end of the ion guide system.

Between the selective quadrupole mass spectrometer (24) and the double helix ion guide system (26) there is a drawing lens system (25) which accelerates the ions into the ion guide system. It is expedient to also use this drawing lens system (25) as a differential pump system (35) in order to maintain the relatively large pressure differential between the quadrupole mass spectrometer (24) and the ion guide system (26).

The reason why the conical or trumpet-shaped design is so favorable is that there is a wide, flat trough of pseudo potential in the injection area (see curve 10 in FIG. 3), which becomes narrower toward the output area (see curve 11 in FIG. 3). In the input area the pseudo potential acts practically only in the vicinity of the wall: an ion beam can be scanned which has substantial spatial and angular scatter. There are no acceptance problems as is the case with other designs of ion guide systems, particularly with quadrupole systems. On their journey through the tapered double helix the pseudo potential trough becomes narrower until it is roughly parabolic at the ion output end (curve 11), with a clear minimum where the ions, which are now practically at rest in the gas, collect.

A conical double helix system (26) can, for instance, begin with an inside diameter of approx. 12 millimeters if the rod distance of the selective quadrupole mass spectrometer is 8 millimeters. Toward the end the cone tapers down to about 4 millimeters. Favorably the distance between the adjacent coiled wires in this case is approx. 1.5 millimeters. At the ion outlet this produces a roughly parabolic potential trough (see curve 11 and U.S. Pat. No. 5,572,035, in which calculated shapes of pseudo potential trough are shown).

It is expedient for the ion guide system (26) to at least partially be surrounded by an envelope (5) which can accommodate the collision and damping gas, but which can also serve as a mechanical fixture for holding the wire coils.

Since the ion guide system (26) is used for fragmentation of the injected ions in order to be able to scan daughter ion spectra of the injected parent ions, the parent ions must be injected with a kinetic energy which is sufficient for their own collisionally induced fragmentation. One must take into account that in the ion guide system there are not only hard collisions which lead to energy absorption in the ion and ultimately to fragmentation but also constantly cooling collisions which can dissipate the energy from the molecular system of the ion again. For this reason accelerations to approx. 10 to 30 electron Volts per ion charge are necessary although the chemical bonding energies in the molecule are only about 3 to 5 electron Volts.

The double helix ion guide system (26) is now filled by the gas feeder (20) with damping gas to such an extent that the residual parent ions and the newly formed daughter ions are completely decelerated in the gas. Depending on the length of the ion guide system (26) a pressure is required of between 0.01 and 100 Pascal. The normally most favorable gas pressure is between 1 and 10 Pascal; for a relatively large ion in nitrogen that produces approx. 50 to 500 collisions per 100 millimeters of journey. The most favorable pressure is determined by experiment. Nitrogen is preferably used as the collision and damping gas. For good fragmentation of the admitted ions heavier gases such as argon have proven successful. However, interestingly even the light helium can be successfully used for fragmentation. The damping gas is admitted to the envelope (5) of the ion guide system or the corresponding vacuum chamber through a separate gas supply pipe (20).

If the ions are completely decelerated, they collect in the pseudo potential trough in the axis of the ion guide system (26). Due to their charge they repel each other and thus disperse themselves with relative uniformity. If the ions in a conical double helix are transported to the narrower end of the ion guide system, they collect more and more along the axis of the system and create a fine ion thread there.

According to the invention it is particularly favorable to also use a gas for transporting the completely decelerated ions through the ion guide system (26): If the gas flows into the system close to the beginning of the envelope of the ion guide system, as shown in FIG. 1, part of the gas flows to the end and can therefore entrain the ions by viscous or molecular gas friction, that is, with large numbers of gentle collisions. In double helix cylindrical ion guide systems without an axial DC field there are no axial forces acting on the ions (except for a possible force due to the space charge of unequally distributed ions); entrainment by the gas is therefore without any resistance. In the conical double helix system (26) in FIG. 1 with a wide entrance, however, a weak pseudo potential field builds up, which drives the ions back to the injection end—a slight resistance must be overcome here.

Transportation of the ions to the end of the ion guide system can, however, also be achieved solely or additionally by different types of forward thrust. For example, the ion guide system can take the form of a cone which opens out toward the end, in which case a pseudo potential field component would arise in the axial direction which could be exploited for transportation. However, this arrangement is not particularly favorable for various reasons and will not be treated in further detail here.

If the gas is unable to transport the ions on its own, a real electric DC field has to be generated along the axis of the ion guide system. This can be performed by applying two equal DC voltages on both sides to the ends (1) and (2), and to (3) and (4) of the two helical wires. (In a borderline case it is sufficient to apply the voltage to only one helical wire; however, this arrangement creates an upper mass limit for the ion guide system). Here it becomes particularly apparent how favorable the double helix is because only two equal DC voltages are necessary, by contrast with a multipole system in which four, six or even eight DC voltages would have to be applied separately to achieve the same effect. The DC voltage supplies then have to be superimposed by the RF voltage. It is expedient to use resistance wires for the double helix and to send only a very low DC current through each of the two wires. Here too the double helix is particularly favorable because the wires are very long due to the coiling and also can be kept very thin, which has a favorable effect on the high resistance. The discharge of RF into the DC supply can be prevented very effectively with RF chokes. The axial DC field only needs to be very weak: 0.01 to a maximum of 1 volt per centimeter is sufficient for forward thrust. Approx. 0.05 V per centimeter should preferably be applied.

It is also sufficient to apply the DC voltages not to the entire double helix coils. Since the first journey of the injected ions is covered using intrinsic kinetic energy, the axial DC field only needs to prevail in the rear two thirds.

The time which the ions require to reach the end of the ion guide system (26) is a few milliseconds. Apart from a very weak mixing due to diffusion, no mixing of early and late injected ions occurs. The ions are removed at the end practically in the same sequence in which they were injected: the temporal resolution of the ion composition remains intact if removal of the ions is continuous at the end. The relatively slow guidance (in a few milliseconds) of the ions, which are then practically at rest, toward the end of the ion guide system (26) also helps to cool the inner energy of the daughter ions and to cause short-living, highly excited daughter ions to decompose. As a result a largely background noise-free daughter ion spectrum is obtained in the quadrupole mass spectrometer (28), which is not contaminated by scattered ions from ion decompositions during flight in the last part of the quadrupole mass spectrometer (28).

Each ion guide system has the property of only collecting and guiding ions above a predefined mass-to-charge ratio. Lighter ions escape from the system. This is referred to as a lower mass limit of the ion guide system; it depends on the geometry of the ion guide system, the frequency and amplitude of the RF voltage. For the analysis of large ions of substances of biochemical interest this limit is generally of no importance. In a conical system (26) with the same wire spacing for the coils the cutoff limit is determined by the narrowest part of the ion guide system.

At a frequency of approx. 6 megahertz and a voltage of approx. 250 volts all the singly charged ions with masses above 50 atomic mass units are focused in a double helix with an inside diameter of approx. 4 millimeters. Lighter ions, for example air ions $N_2^+$ and $O_2^+$, leave the ion guide. With higher voltages or lower frequencies the cutoff limit for the ion masses can be increased. The exact function of the lower mass cutoff limit relative to voltage and frequency is determined by a calibration process experimentally.

An upper mass limit does not exist for such a system if the phases of the RF voltage are not superimposed with DC voltage; the above-mentioned DC voltages along the wires do not create any upper mass limit.

If the ions are guided to the end of the ion guide system (26), it is favorable for them to be extracted by a drawing lens system (27). A drawing lens system is an ion-optical means by which homogeneous-energy ions can be formed into a fine ion beam, whereby the ions are accelerated simultaneously. A fine parallel beam is particularly favorable for injection into the analytical quadrupole mass spectrometer and in this way it is possible to achieve a high ion acceptance.

The ions, which now only have thermal energy and are strung along the axis of the ion guide system (26) in a thread, can thus be excellently formed into an extremely fine primary ion beam with substantial energy homogeneity, which is directed into the analytical quadrupole mass spectrometer (28), using a drawing lens system (27). The ions in the fine primary ion beam, which is formed by the drawing lens system (27), are accelerated by an adjustable voltage to an energy which is particularly favorable for the mass resolving power in the quadrupole mass spectrometer (28). Depending on the length of the quadrupole mass spectrometer (28) the energies are between approx. 3 and 6 electron Volts. Injection outside of the axis or a slightly oblique injection is also favorable in many cases. The most favorable setting (location, angle, energy) for the generated ion beam depends on the properties of the quadrupole mass spectrometer (28); it can easily be determined by experiment.

The analytically filtered ion beam which passes through the analytical quadrupole mass spectrometer (28) is measured in an ion beam detector (29). From this measuring signal the analytical result is obtained.

It is expedient for the drawing lens system (27) to be comprised of a drawing lens which extracts the ions from the ion guide system and normally generates an intermediate focus, as well as a downstream Einzel lens which images the intermediate focus into the quadrupole mass spectrometer (28). The system comprised of the drawing lens and the Einzel lens can in an extreme case be reduced to only four apertured diaphragms (as symbolically represented in FIG. 1), of which the last three form the Einzel lens. However, it is favorable to use a system comprised of five apertured diaphragms, whereby the first three apertured diaphragms form the drawing lens and the last three apertured diaphragms form the Einzel lens. The center apertured diaphragm belongs to the two lenses jointly. The first apertured diaphragm is located practically at the axial potential of the ion guide system (26), while the third and fifth are at the acceleration potential for the ions in the primary beam. The potential of the second diaphragm controls the ion extraction of the drawing lens and the potential of the fourth diaphragm controls the focal length of the Einzel lens.

Naturally in the quadrupole mass spectrometer (28) a better vacuum must prevail than in the ion guide system (26), which is used as a fragmentation cell. In the ion guide system (26) there is intentionally a gas pressure which generates a very large number of collisions with the ions. The spectrometer (28) and ion guide system (26) must therefore be accommodated in different vacuum chambers (38) and (36), which contain vacuums of various integrity.

Ion passage between the two chambers (38) and (36) must thus not have a good conductivity for the passage of gases. It is therefore expedient to make the drawing lens diaphragm with the smallest hole the only connection between the chambers, that is, to integrate the diaphragm into the wall between the two chambers with a gastight seal. If the drawing lens is calculated correctly, the diaphragm aperture can have a diameter of approx. 0.5 to 1 millimeter, without cutting the ion beam to any major extent. This diaphragm can also be designed as a small channel which once again reduces the conductivity of the aperture. For a vacuum pump with a high suction capacity at the spectrometer chamber this arrangement is sufficient. If for economic reasons a smaller pump has to be used, it is favorable to evacuate the drawing lens system (27) between two suitable diaphragms specially, i.e. to select a differential pump arrangement with its own chamber (37), whereby the two selected apertured diaphragms serve as a limitation, as shown in FIG. 1. Various differential pump chambers, such as chambers (33), (35), and (37), can be evacuated by a single vacuum pump.

Spectrometer chambers (34) and (38) can also be evacuated by a single high vacuum pump.

Furthermore, it is helpful for maintaining a good pressure in the quadrupole mass spectrometer (28) if in the ion guide system (26) the pressure of the damping gas decreases toward the end. This can be achieved if the gas flows into the enveloped ion guide system (26) at the beginning and if due to openings in the envelope along the ion guide system a continuous or discontinuous pressure drop is generated so that at the apertured diaphragm with the spectrometer chamber there is no longer any extremely high gas density.

An ion guide (26) in the form of a double helix is very easy to manufacture. Using a two-turn screw core, which can be very simply made for this purpose on a lathe, the two wires of the double helix can be very easily coiled, whereby the wires are laid into the two thread turns of the two-turn screw core. It is advantageous if the thread turns are less than half as deep as the wire diameter. Sprung hard wire can be precoiled by winding onto a thin core beforehand and then stretching so that there is virtually no longer any winding tension. Then insulating retaining strips or—as envelopes (5)—insulating half-shells can be stuck or soldered onto the windings while the windings are still on the screw core. The half-shells can have holes in order to create a pressure drop toward the end. The retaining strips or half-shells can be made from glass, ceramics, or even from plastics. The retaining strips or half-shells can have circular grooves milled obliquely which correspond to the diameter, distance, and pitch of the wires. By bonding or soldering a very firm structure is created. After the adhesive has set the screw core, which has been lightly greased beforehand, can be unscrewed from the structure. The finished ion guide system then forms a robust structure which is highly resistant to mechanical damage and vibration.

Conical or trumpet-shaped double helix systems can also be made in this way if the wire spacing in the axial direction remains the same, as shown in FIG. 2. The thread core here can be unscrewed even more easily than that of a cylindrical system.

With the basic principles of the invention indicated here any specialist in developing mass spectrometers can very easily develop tandem quadrupole mass spectrometers which are adjusted to certain analytical tasks in a particularly expedient manner.

What is claimed is:

1. Tandem quadrupole mass spectrometer comprising:

a parent ion selecting quadrupole mass spectrometer;

a daughter ion analyzing quadrupole mass spectrometer; and a ion guide system having a collisionally induced fragmentation cell such that the ion guide system receives parent ions output from the parent ion selecting mass spectrometer and fragments them into daughter ions, the daughter ions being input from the ion guide system to the daughter ion analyzing mass spectrometer, wherein the fragmentation cell includes an active forward thrust system that interacts with daughter ions in the fragmentation cell and causes the daughter ions to be transported through the ion guide system.

2. Tandem quadrupole mass spectrometer according to claim 1, wherein the ion guide system comprises a pair of coiled wires in the form of a double helix.

3. Tandem quadrupole mass spectrometer according to claim 2, wherein the double helix is conical or trumpet-shaped, and a larger inside diameter of the ion guide is at the end into which ions are introduced.

4. Tandem quadrupole mass spectrometer according to claim 1, wherein the ion guide system is largely enclosed in an envelope.

5. Tandem quadrupole mass spectrometer according to claim 1, wherein the gas density in the ion guide system can be set with a gas supply sufficiently high for the injected ions to practically come to rest in the gas of the ion guide system.

6. Tandem quadrupole mass spectrometer according to claim 5, wherein the ion guide system contains a collision gas.

7. Tandem quadrupole mass spectrometer according to claim 6, wherein the ion transportation is solely or partially caused by the collision gas itself which flows, after being admitted in the vicinity of ion injection, at least partially to the end of the ion guide system.

8. Tandem quadrupole mass spectrometer according to claim 1, wherein the ion transportation is solely or partially caused by an axial DC field.

9. Tandem quadrupole mass spectrometer according to claim 8, wherein the axial DC field is caused by two parallel DC voltages which are each applied to two connection points each on the two helical wires.

10. Tandem quadrupole mass spectrometer according to claim 9, wherein the helical wires are made from resistance wire.

11. Tandem quadrupole mass spectrometer according to claim 1, wherein the daughter ions are extracted from the ion guide system using a drawing lens system and are injected into the daughter ion analyzing quadrupole mass spectrometer.

12. Tandem quadrupole mass spectrometer according to claim 11, wherein an apertured diaphragm of the drawing lens system forms part of a wall between a vacuum chamber for the ion guide system and a vacuum chamber for the daughter ion analyzing quadrupole mass spectrometer.

13. Tandem quadrupole mass spectrometer according to claim 11, wherein the drawing lens system comprises a differential pump stage between the vacuum chambers for the ion guide system and the daughter ion analyzing quadrupole mass spectrometer.

14. Method for the measurement of daughter ions with a tandem quadrupole mass spectrometer, the method comprising:

selecting ions with a parent ion selecting quadrupole mass spectrometer;

injecting said ions into an ion guide system in such a way that they are fragmented in a collision gas contained in a fragmentation cell of the ion guide system; and transporting the fragmented ions to the end of the ion guide system using an active forward thrust system that interacts with the ions in the fragmentation cell.

* * * * *